US005291702A

United States Patent [19]

Hooper

[11] Patent Number: 5,291,702

[45] Date of Patent: Mar. 8, 1994

[54] CURVED SURFACE BUILDING MODULES

[76] Inventor: Percy R. Hooper, 570 S.W. Maynard Rd., Cary, N.C. 27511

[21] Appl. No.: 755,103

[22] Filed: Sep. 5, 1991

[51] Int. Cl.[5] ..... E04B 1/32

[52] U.S. Cl. ..... 52/80.1; 52/81.4; 52/271

[58] Field of Search ..... 52/80 OR, 81, 608, 52/584, 86, 282.1, 271

[56] References Cited

U.S. PATENT DOCUMENTS

| | | | |
|---|---|---|---|
| 3,533,202 | 10/1970 | Gellert | 52/80 |
| 3,557,501 | 1/1969 | Kolozsvary | 52/86 |
| 3,738,083 | 6/1973 | Shimano | 52/271 |
| 4,425,740 | 1/1984 | Golden | 52/271 |
| 5,036,635 | 8/1991 | Lalvani | 52/80 |

*Primary Examiner*—Carl D. Friedman
*Assistant Examiner*—Wynn E. Wood
*Attorney, Agent, or Firm*—Rhodes, Coats & Bennett

[57] ABSTRACT

A three-dimensional, curved building module comprises a saddle-shaped module bounded by at least four edge surfaces. Each of the edge surfaces lie in a respective plane of a circumscribing cube. Connecting means are formed along the edge surfaces for joining the modules in edge-to-edge relation with one another. The building modules permit construction of complex, three dimensional forms which divide space into two distinct but intertwining volumes. The building modules may be used as a child's construction toy, or to build sculptures, or to build architectural structures.

5 Claims, 11 Drawing Sheets

CURVED SURFACE BUILDING MODULES

BACKGROUND OF THE INVENTION

The present invention relates generally to educational building systems and more particularly polygonal building modules having curved, saddle shaped surfaces which can be connected edge-to-edge to form labyrinth-like space-filling structures.

The history of educational building blocks is extensive. The earliest building blocks, aside from stones or bricks stacked upon one another, were probably simple wooden blocks made for stacking. In the 1950's, toy building systems were introduced which included columns and beams that could be snapped together to create an X-Y-Z coordinate framework. Flat modules could also be snapped onto the framework to create three-dimensional space enclosing structures. This type of building system however, is limited since all of the components are essentially two-dimensional. The columns and beams correspond to line segments while the flat modules correspond to finite planar elements. In such a building system, the child perceives his three-dimensional construction as a composite of two-dimensional components. A further drawback of this type of building system is that it comprises many loose components which when left in the hands of children are easily lost.

In U.S. Pat. No. 4,055,019, there is disclosed a construction toy consisting of a plurality of multi-sided planar elements that snap together edge-to-edge to form various polyhedra. The construction toy is intended to teach children about relatively complex solid geometrics. However, like the X-Y-Z frameworks, the three-dimensional construction is still perceived as a composite of two-dimensional components. Moreover, the construction toy does not invite children to explore and learn about the intricately shaped voids that are inherently created in between the solid, physical components that bound them.

In U.S. Pat. No. 3,931,697, curved surface modules are disclosed which can be assembled into integral self-supporting structures. The patent discloses a method for joining such modules to create a playground structure. The method uses hingeable flanges on the curved surface modules which are fastened together with metal brackets and bolts. The joining method disclosed is not suitable for a child's construction toy since the components themselves are too large for a child to move safely, and the fasteners involve many loose connectors that require special tools to build the assembly.

As yet, no construction system exists that allows rigid, curved surface modules to be easily assembled and disassembled with enough ease to make the system suitable for use as a construction toy.

SUMMARY AND OBJECTS OF THE INVENTION

The present invention is a modular construction system for children which consists of a plurality of identical four-sided modules which can be "snapped together" to build a three-dimensional, space-enclosing structure. Each module consists of a saddle-shaped membrane of constant thickness bounded by four identical, contiguous edge surfaces. Each bounding edge lies essentially flush with the face of a circumscribing cube while simultaneously lying along the edge of a circumscribing polyhedron.

The configuration of the module edge allows it to join to other modules in two different edge-to-edge configurations. One joint configuration allows the curved form of the module surface to flow smoothly across the connection to the adjoining module without interruption. The adjoining module continues the curve where the first module left off. The second configuration attaches the two modules such that one module appears to be the mirror image of the adjoining module. The plane where the two modules join is the apparent mirror plane. With this configuration, the curved surface of the module makes an abrupt change of direction where the two modules join.

The modules, when connected, form a continuous curving surface which folds back upon itself creating tunnels, caverns, jagged expanses and towering spires. The undulating membrane of curving modules divides the space in which it is constructed into two separate and distinct volumes of space, intertwining and interpenetrating, but always separated by the curving continuous module membrane. The complex forms the child constructs will expose him to and encourage him to manipulate complex space relationships not attainable in conventional building blocks or flat module/I-beam construction systems. The system allows the child to build a three-dimensional labyrinth for his imagination to explore and populate.

It is, therefore, an object of the present invention to provide a set of curved surface building modules which can be joined together to form an integral, self-supporting, space enclosing structure.

Another object of the present invention is to provide a set of curved surface building modules with integrally formed joining means that can be used as a construction toy.

Another object of the present invention is to provide a set of curved surface building modules that can be compactly stacked upon one another for efficient storage.

Other objects and advantages of the present invention will become apparent and obvious from a study of the following description and the accompanying drawings which are merely illustrative of such invention.

DETAILED DESCRIPTION OF THE INVENTION

Figure 1:
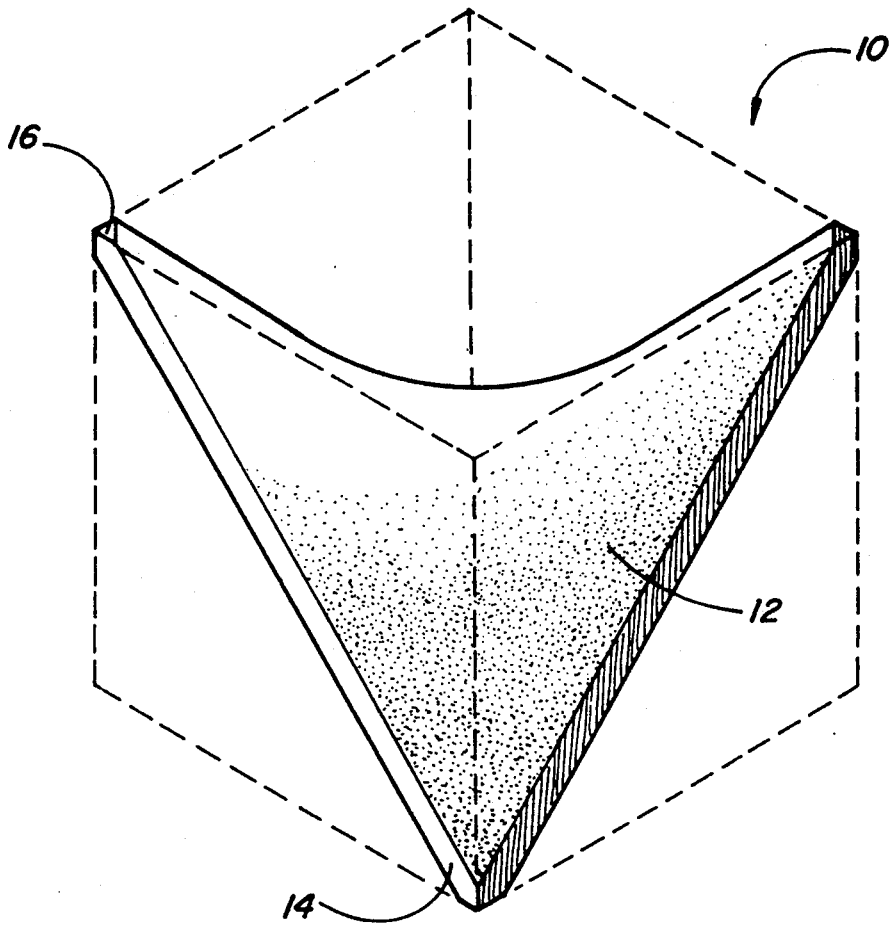
FIG. 1 is an isometric view of a saddle-shaped membrane forming the basis of the present invention.

Referring now to FIG. 1, a building module in the form of a hyperbolic paraboloid is shown and indicated generally by the numeral 10. The building module 10 comprises a saddle shaped membrane 12 having four edge surfaces 14 which form a skewed polygon. Each of the four edge surfaces 14 lies in a respective plane of a circumscribing cube indicated by dotted lines in FIG. 1. The corners where adjacent edge surfaces 16 meet are truncated so as to leave small triangular surfaces 16. The truncation of the corners is necessary so that the modules 10 can be joined together. The small triangular surfaces 16 also lie in a respective plane of the circumscribing cube. In particular, two small triangular surfaces 16 lie in each of the top and bottom planes of the circumscribing cube.

Figure 2:
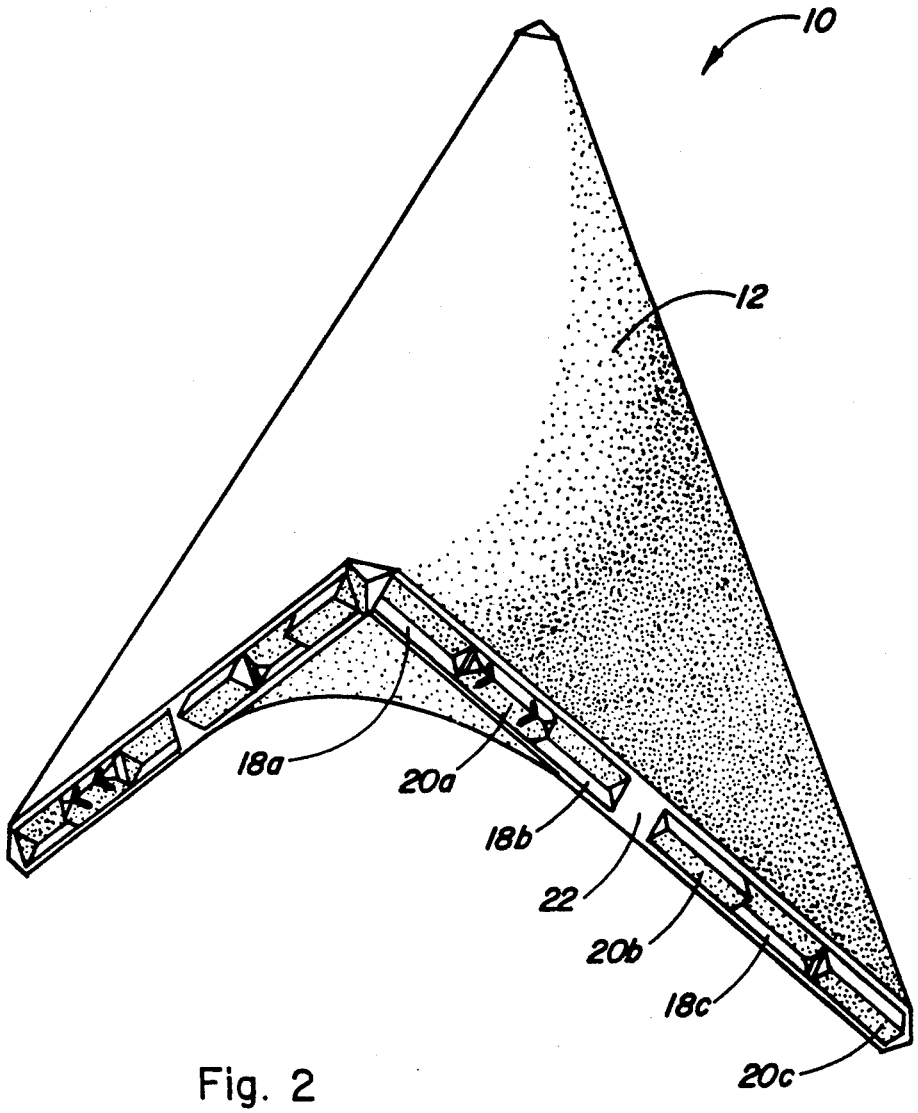
FIG. 2 is a perspective view of a saddle-shaped building module of the present invention.

Referring now to FIG. 2, a building module 10 is shown having integrally formed connecting means for joining the saddle shaped modules in edge-to-edge relation. The means of joining two modules together comprises a series of alternating protrusions 18*a*, 18*b*, and 18*c* and recesses 20*a*, 20*b*, and 20*c* integrally formed on the edge surfaces. In the embodiment shown, the recesses and protrusions are arranged into two groups. One group comprises two recesses 18*a* and 18*b* separated by a central protrusion 20*a*. The other group comprises two protrusions 20*b* and 20*c* separated by a central recess 18*c*. All of the recesses and protrusions are contained entirely within the edge surface. That is, the edge surface defines a narrow shoulder 22 extending along the sides and ends of each group of protrusions and recesses. Thus, the protrusions and recesses are concealed when two modules are joined together.

The shape of the protrusions and recesses is not critical to the invention. However, in the embodiment shown in FIGS. 2–4, the protrusions and recesses have a generally triangular shape. Each protrusion consists of two inclined surfaces rising outwardly from the edge surface which meet to form a linearly extending apex. Similarly, the recesses include two inclined surfaces which extend inwardly from the edge surface and meet to form a linearly extending nadir. The end surfaces of the recesses and depressions extend perpendicularly to the edge surface of the module.

Figure 3:
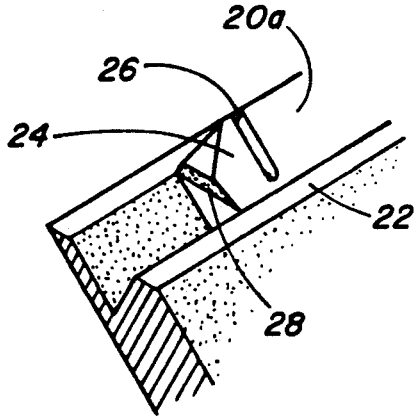
FIGS. 3 and 4 are detailed perspective views illustrating the connecting means for joining two or more modules together.
Figure 4:
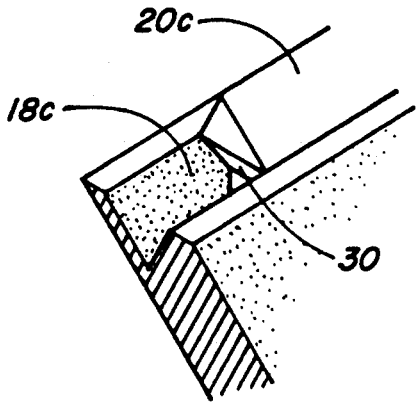

To further assist in holding the building modules 10 together, the central protrusion 20*a* in the first group of protrusions and recesses includes a slot 26 adjacent the ends of the protrusion 20*b* which forms a pair of resilient tabs 24. The tabs 24 are best seen in FIG. 3. The resilient tabs 24 have small cleats 28 formed thereon whose purpose will become apparent. The central recess 18*c* in the second group of protrusions and recesses includes a pair of indentations 30 formed in the end surfaces of the recess 18*c*. The indentations 30 are adapted to be engaged by the cleats 28 on the resilient tabs 24. As two modules are pressed together, the resilient tabs 24 yield to allow the edge surfaces 14 of adjacent modules to make face-to-face contact. When the edge surfaces 14 make face-to-face contact, the resilient tab 24 snaps into a locking position in which the cleats 28 are engaged with the indentations 30. The engagement of the cleats 28 with the indentations 30 holds the modules tightly together and secures them from lateral movement. The modules can be separated by simply pulling the modules apart. As the modules are being pulled apart, the resilient tabs 24 yield so that the cleats 28 disengage from the indentations 30.

Figure 12A:
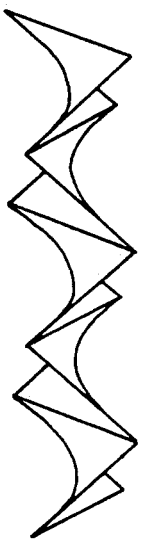
FIG. 12*a* is an elevation view illustrating a linear array consisting of five building modules connected together using a mirror image joint.
Figure 12B:
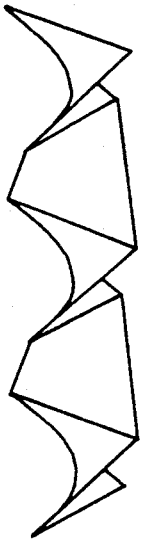
FIG. 12*b* is a linear array consisting of five building modules connected together using a right-hand helix joint.
Figure 12C:
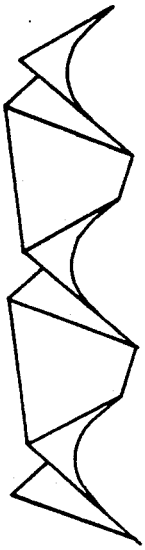
FIG. 12*c* is a elevation view of a linear array consisting of five building modules connected together using a left-hand helix joint.
Figure 12D:
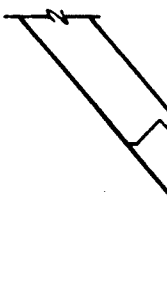
FIG. 12*d* is a side view showing a joint connection where the curved surfaces of adjacent modules flow smoothly across the joint without apparent surface interruption.
Figure 12E:
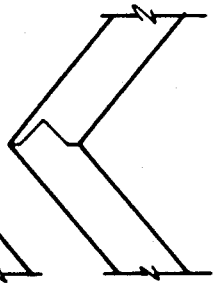
FIG. 12*e* is a side view of a joint connection where the curve surfaces of the connected modules make an abrupt change of direction at the joint.
Figure 12F:
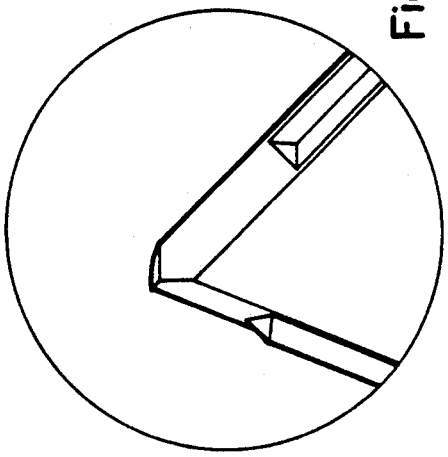
FIG. 12*f* is a perspective view showing the joint of two connected modules where the modules are of the embodiment shown in FIG. 2.

From the foregoing, it is apparent that two or more modules can be joined together in edge-to-edge relation so that the protrusions on a first module insert into a corresponding recess in a second module, while the recesses in the first module receive the protrusions on the second module. Since the protrusions and recesses are contained entirely within the edge surface, as shown in FIG. 12F of the modules, the protrusions and recesses are concealed by the face-to-face contact of the edge surfaces. Thus, the continuity of the curved surfaces is not interrupted or disturbed. Thus, a three-dimensional construction made using the modules of the present invention will have a graceful, sculptural quality not found in prior art construction toys.

Figure 5:
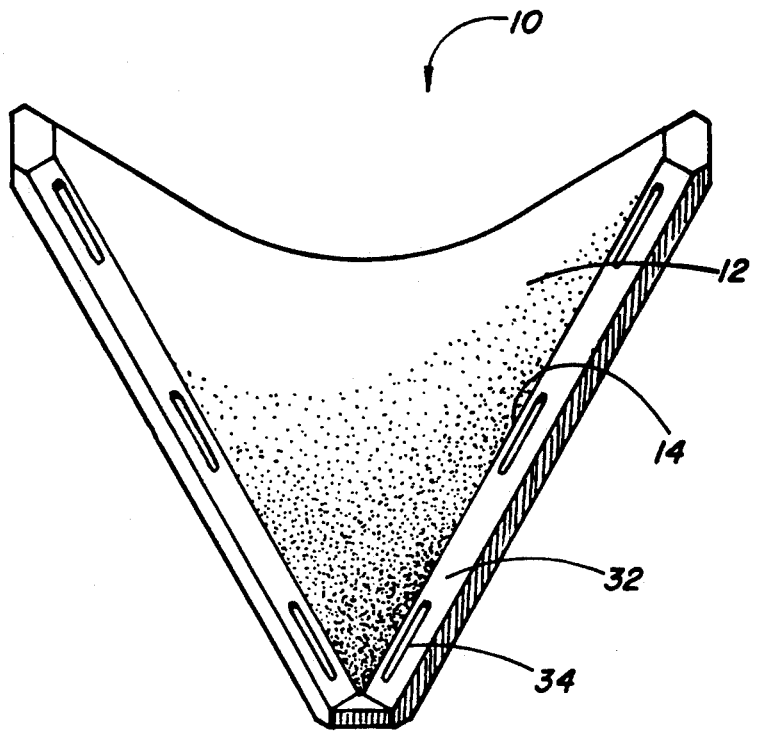
FIG. 5 is a perspective view illustrating a second embodiment of the saddle-shaped membrane.
Figure 6:
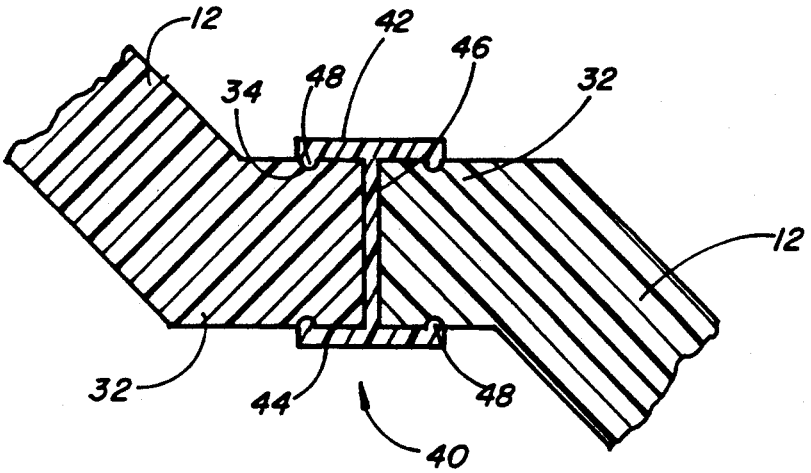
FIG. 6 is a section view illustrating the connecting means for joining two or more building modules together.

Referring now to FIGS. 5 and 6, a second embodiment of the present invention is shown. The building module 10 of the second embodiment comprises a saddle-shaped membrane 12 of constant thickness bounded by four edges 14 which form a polygon. Each of the bounding edges 14 lies flush with the face of a circumscribing cube. Projecting outwardly from the four edges of the module are four flanges 32 of similar thickness as the saddle-shaped membrane 12. Each flange 32 extends perpendicularly from the face of the circumscribing cube and is continuous with the flange 32 projecting from an adjacent edge surface such that the flanges form a continuous border around the saddle-shaped membrane.

On the top and bottom of each flange 32 are one or more elongated grooves 34 that run parallel with the edge 14. These elongated grooves 34 are located near the crease formed where the flange 14 joins the edge of the saddle-shaped membrane. As will be hereinafter described, this groove 34 is engaged by a corresponding projection of an H-beam connector 40 to secure the modules together.

The H-beam connector 40, shown best in FIG. 6, is an elongated member whose length is equal to the length of one edge of the saddle-shaped membrane. The H-beam connector 40 includes a top member 42, a bottom member 44, and an intermediate member 46 connecting the top or bottom members together. The connector 40 has two C-shaped channels on opposite sides of the intermediate member 46 which are sized to receive the flanges 32 of the building modules 10. Projections 48 extend along the edges of the top and bottom members which engage with the elongated grooves 34 on the flanges 32 to form a secure connection between the H-beam connector 40 and the building module 10.

To use the connector of the this embodiment, the flange 32 along one edge of a first module 10 is inserted into one channel of the H-beam connector 40, and the flange 32 of an adjoining module 10 is inserted into the opposite channel of the same connector 40. The flange 32 of any module 10 can be inserted into either channel of the H-beam connector 40.

Figure 7:
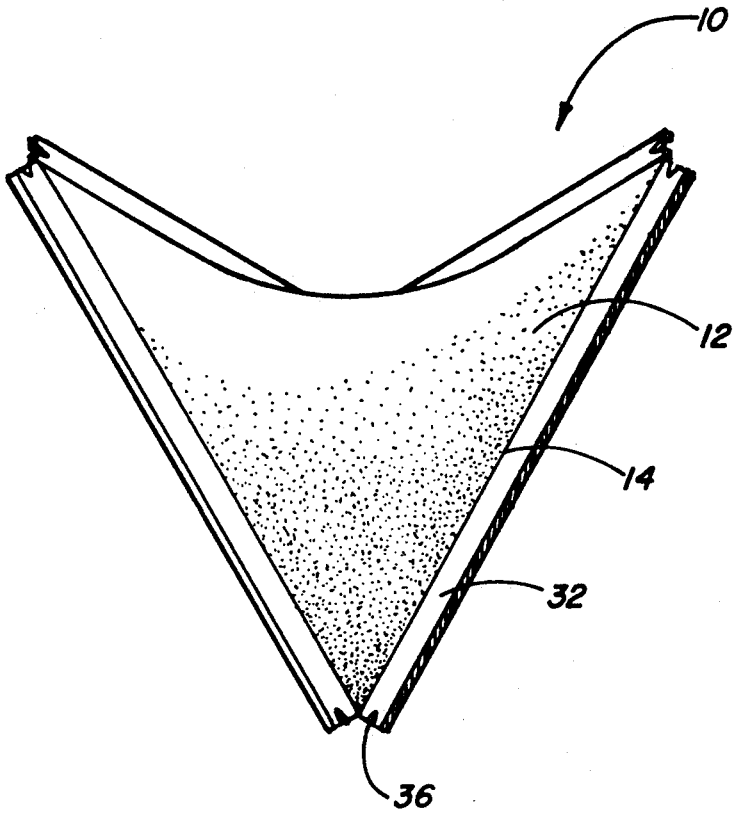
FIG. 7 is a perspective view illustrating a third embodiment of the saddle-shaped building module.
Figure 8:
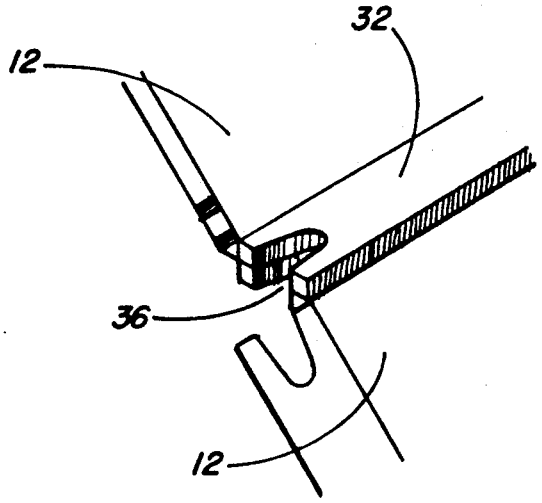
FIGS. 8 and 9 are detailed perspective views illustrating the connecting means for joining two or more building modules.
Figure 9:
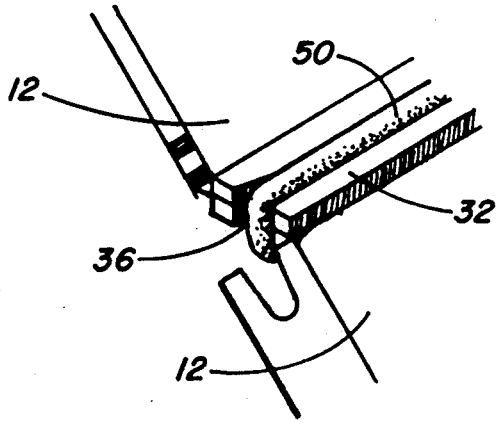

Referring now to FIGS. 7–9, a third embodiment of the present invention is shown. In this embodiment, each module comprises a thin saddle-shaped membrane 12 of constant thickness bonded by four edges 14. Flanges 32 project outwardly from the face of the circumscribing cube and extend the full length of the edge of the saddle-shaped membrane. However, unlike the previous embodiment, the flanges 32 on adjacent edges of the saddle-shaped membrane 12 are not joined. Instead, the ends of the flanges 32 are formed with a notch 36 to receive an elastic band connector 50.

The modules of the third embodiment are joined to one another by laying the flange 32 of one module 10 on top of the flange 32 of an adjacent module 10 such that the notches 36 on the two overlapping flanges 32 are aligned as shown in FIG. 8. The elastic band connector 50 is stretched around the adjoining flanges 32 and is secured in the notches 36 thus locking the two modules into a stable position relative to each other. If desired, an additional wedge-shaped notch can be located on the center of each flange 32 allowing the elastic band 50 to "criss-cross" itself midway down the length of the flange 32 by passing through the wedge shaped notch. The elastic band 50 would take on a figure-eight configuration enhancing the ability of the elastic bands 50 to securely hold the two modules 10 together.

Figure 10:
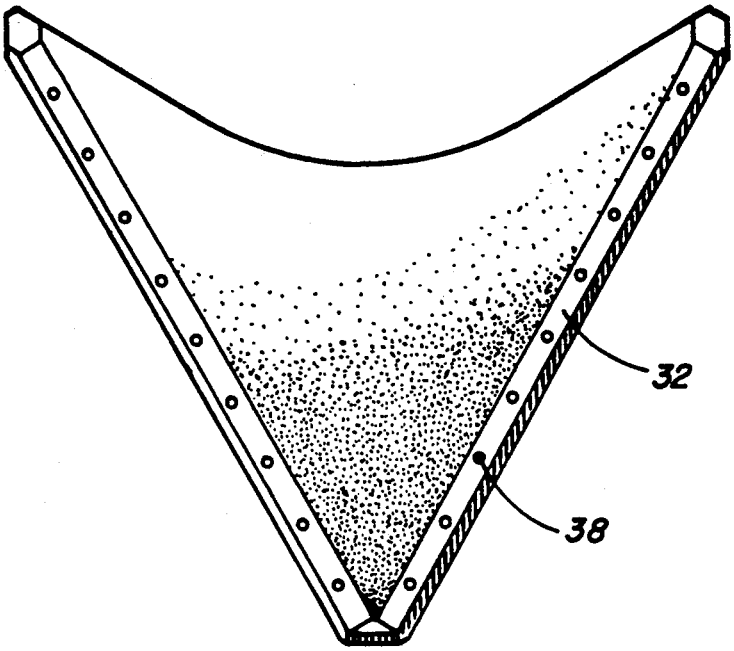
FIG. 10 is a perspective view illustrating a forth embodiment of the building module 10.
Figure 11:
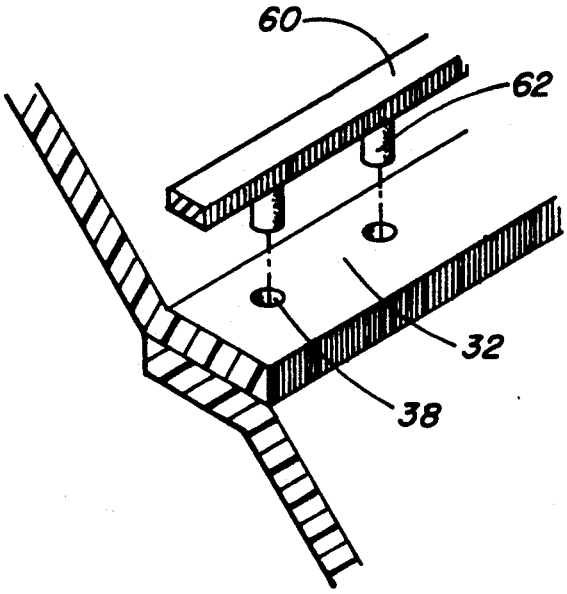
FIG. 11 is a detailed perspective view illustrating the connecting means for joining two or more modules together.

In FIGS. 10 and 11, a fourth embodiment of the present invention is shown. In this embodiment, each module comprises a thin-saddle shaped membrane 12 having four flanges 32 along its four edges 14. In this regard, the forth embodiment is identical to the previous embodiment. However, instead of notches formed in the ends of the flanges 32, the fourth embodiment includes a plurality of openings 38 longitudinally spaced along the length of each flange 32. The holes 38 in the flanges 32 are positioned so that when the flanges 32 are placed in overlapping position with respect to one another, the holes 38 in one flange 38 align with the holes 38 in the other flange 32. A strip connector 60 secures the flanges together. The strip connector 60 comprises an elongated, relatively rigid strip whose length is approximately equal to the length of a flange. The strip has a series of pegs 62 projecting from one side thereof which are spaced the same distance as the holes 38 in the flange 32. The pegs 62 are sized to provide a frictional fit with the holes 38 in the flange 32. Thus, the two modules 10 can be joined together by simply inserting the pegs 62 of the strip connector 60 into the aligned holes 38 of two overlapping flanges 32 as shown in FIG. 11.

For all embodiments of the invention, individual modules can be joined together in any one of three ways. The two joint configurations, hereinafter referred to as the right-handed and left-handed helix joints, allow the curved surfaces of adjacent modules to flow smoothly across the joint without apparent surface interruption, as shown in FIG. 12D, so that the second module continues the curve where the first module left off. If a series of modules are connected linearly in this manner, the curved surfaces of the modules would form a helix. FIG. 12B shows a linear array of five modules 10 connected together using left-handed helix joints. FIG. 12C shows a linear array of five modules 10 joined using right-handed helix joints. In a third joint configuration, hereinafter referred to as the mirror image joint, the curved surfaces of the adjacent modules appear to be mirror images of one another. The plane where the two modules join is the apparent mirror plane. In this configuration, the curved surfaces of the modules makes an abrupt change of direction at the joint where the two modules are connected, as shown in FIG. 12E. FIG. 7A shows a linear construction using only mirror-image joints.

Using identical modules 10, an infinite variety of space enclosing structures can be formed. The space enclosing structures may be relatively simple undulating planes, finite polyhedra, or finite three-dimensional structures capable of infinite expansion. In any case, the structure will always divide the space it occupies into two distinct but complementary tunnel regions. The tunnel regions are separated by the continuous, three dimensional membrane formed by the modules. Examples of structures which can be formed are shown in FIGS. 13–18.

Figure 13:
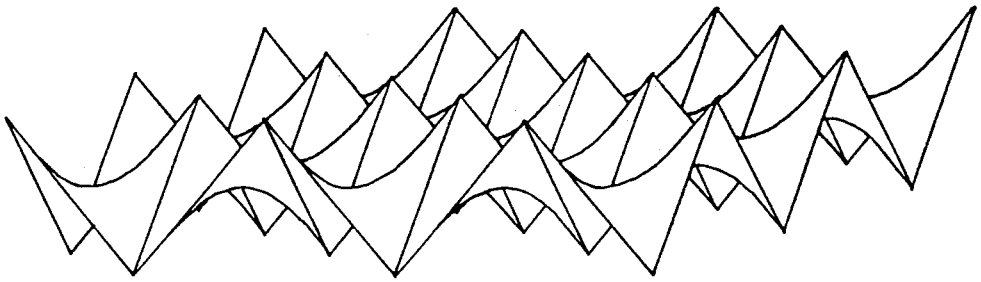
FIGS. 13 and 14 are perspective views of a planar array consisting of twenty-five individual building modules.
Figure 14:
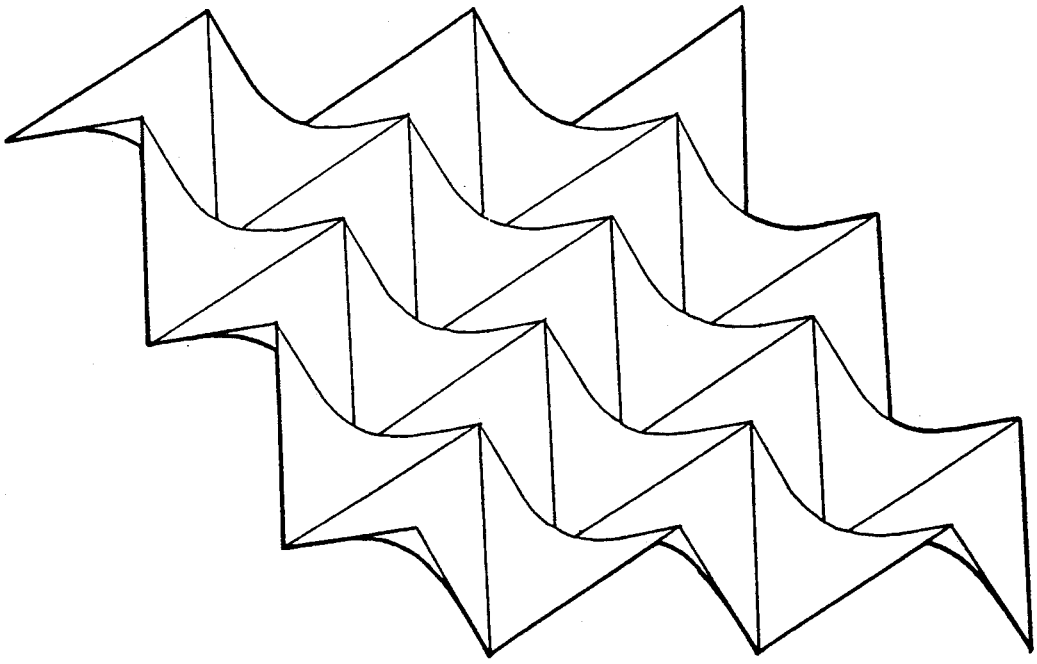

FIGS. 13 and 14 illustrate a series of 25 curved surface modules 10 connected together to form a continuous, uninterrupted planar structure. The structure shown in these FIGS. 8A and 8B employs only the mirror-image joints and all the modules lie in the same plane. As seen in the Figures, the structure extends essentially in two dimensions and is unbroken.

Figure 15:
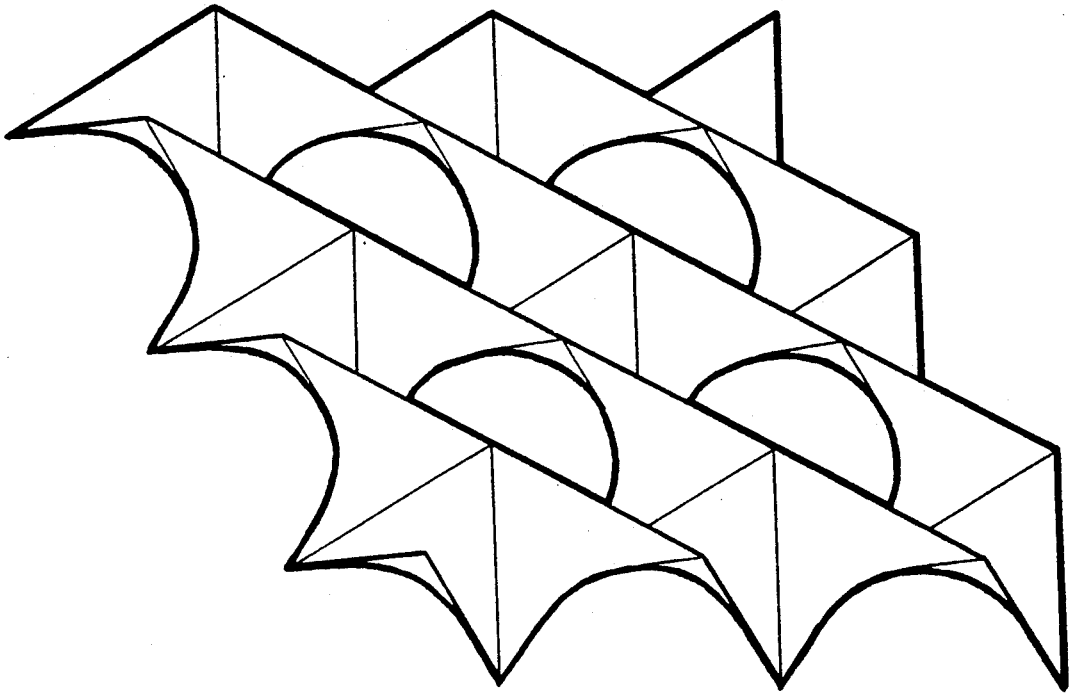
FIG. 15 is another planar array consisting of twenty-five building modules.

FIG. 15 shows another generally planar membrane structure formed with 25 curved surface modules 10. The membrane structure shown in FIG. 15 differs from the structure shown in FIGS. 13 and 14 in that it employs both helix joints and mirror image joints. The membrane structure in FIG. 15 includes a series of voids or tunnels which appear to pass through the membrane.

Figure 16:
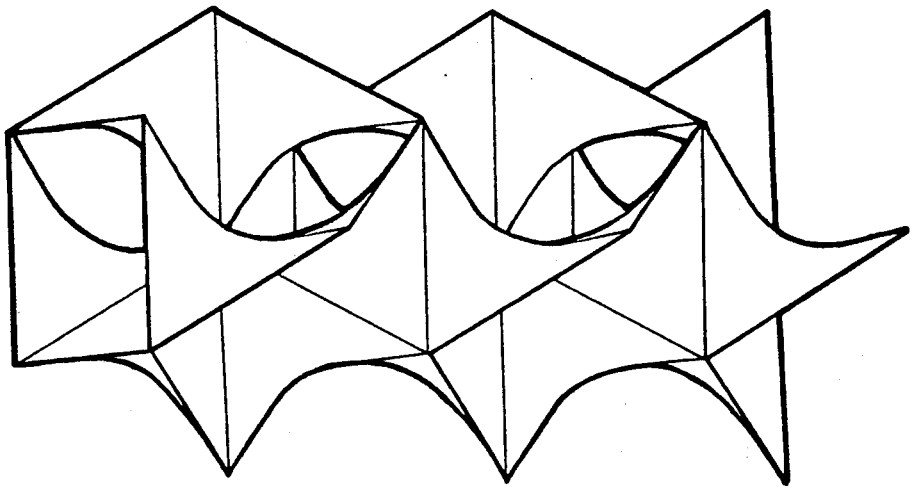
FIG. 16 is a column-like structure consisting twenty building modules.

FIG. 16 illustrates a volumetric array of 20 building modules using all three joint types. The structure in FIG. 16 can be constructed by first assembling 4 linear arrays of 5 modules each. Two linear arrays employ right-handed helix joints as shown in FIG. 12B while the other two linear arrays employ left-handed helix joints as shown in FIG. 12C. All four linear arrays are then joined together using mirror-image joints to form the column-like structure of FIG. 16. The structure is penetrated by several continuous, intertwining curving tunnels or labyrinths which are complementary but never intersect.

Figure 17:
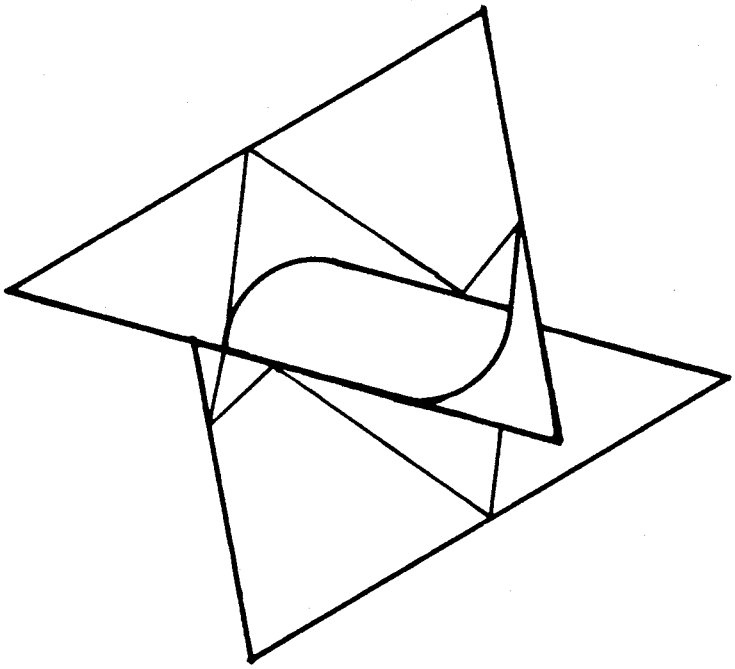
FIG. 17 is a volume metric array consisting of six individual building modules.

FIG. 17 illustrates a volumetric array of 6 modules using both right-handed and left-handed helix joints. The structure is made by first forming three linear arrays of two modules each using either right-handed or left-handed helix joints. The linear arrays are the joined edge-to-edge using the opposite helix joints.

Figure 18:
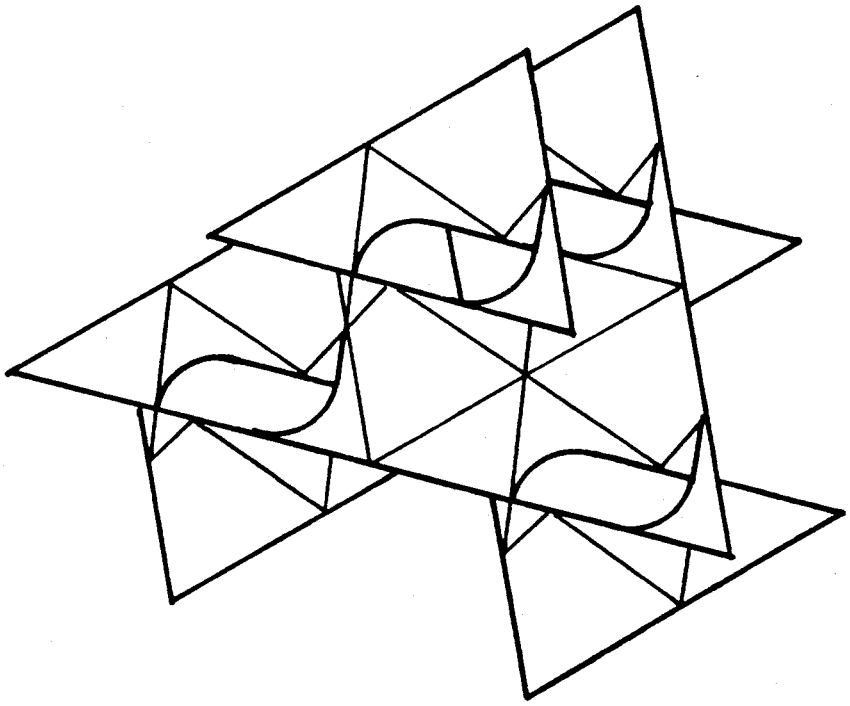
FIG. 18 is a volumetric array consisting of twenty-four building modules.

FIG. 18 shows a larger volumetric array of 24 modules. The volumetric array in FIG. 18 consists of four smaller arrays identical to those shown in FIG. 17.

Figure 19:
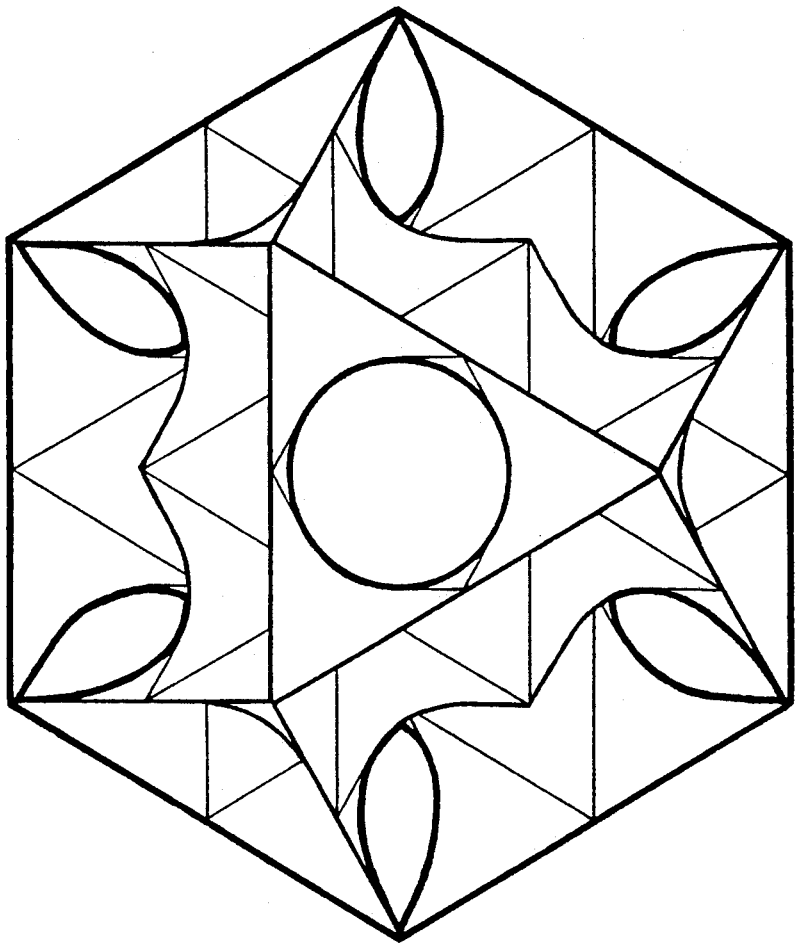
FIG. 19 is a large volumetric array in the form of a finite polyhedron.

FIG. 19 shows a finite polyhedron made of the building modules 10. The finite polyhedron is assembled entirely of four-sided modules using both helix joints and mirror-image joints. The finite polyhedron shown in FIG. 19 has essentially fourteen sides—six of which are square and eight of which are triangular. The structure is penetrated by two continuous, intertwining curving tunnels or labyrinths which are complementary but never intersect.

The complex systems which can be constructed using identical modules are far more interesting than conventional X-Y-Z frameworks with which most people are familiar. Thus, the building modules stimulate a child's exploration of complex spatial relationships. To further the enjoyment, the chips can be made of different colors or display designs imprinted thereon. For example, each module could be given two different colors such that one surface of the module could be colored with color "A" while the opposite side of the module could be colored with a contrasting color "B." This color-coded arrangement would emphasize the interesting fact that any structure built with these modules will effectively divide a space into two separate, but complimentary volumes corresponding to the volume surrounded by color "A" in contrast to the volume surrounded by a color "B."

Figure 20:
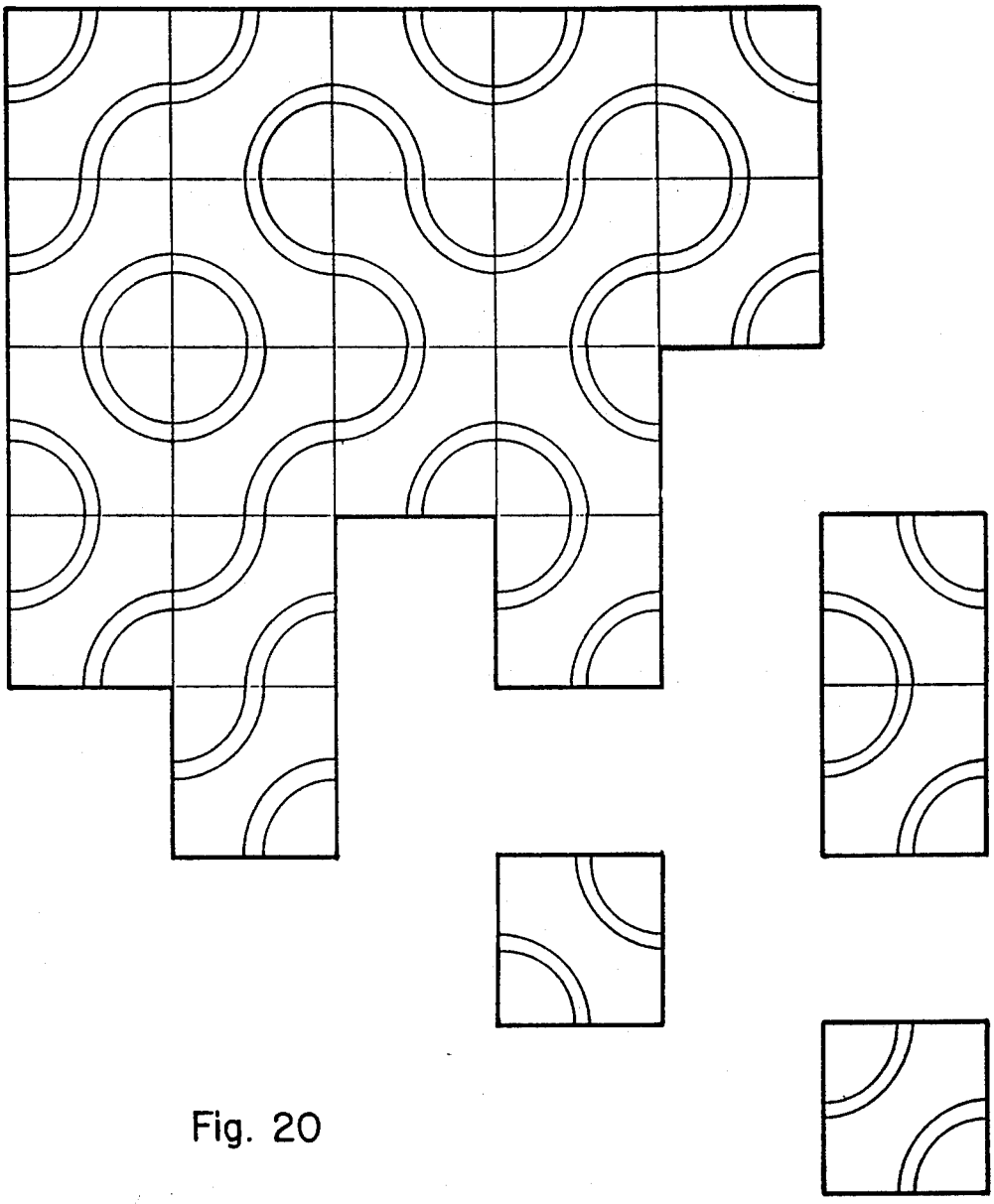
FIG. 20 is a plan view of a planar array with a surface pattern applied to the building modules.

An even more intricate color system could be employed, as shown in FIG. 20. As indicated, the modules may have arcuate-shaped lines on the curved surfaces which begin at the center of one edge and extend to the center of an adjacent edge. Each surface may have two curved lines. When two modules are joined, the line will appear to be continuous and will extend from module to module. The line could close on itself to form a circle or meander about indefinitely.

What is claimed is:

1. A modular building system comprising:

a) a plurality of saddle-shaped modules adapted to be joined together to form a space-enclosing structure, each saddle-shaped module including two continuously curved surfaces joined by four edges lying in respective planes of a circumscribing cube, and a flange extending along each edge perpendicularly from the plane of the circumscribing cube; and b) connecting means for adjoining two or more modules together, said connecting means including an elongated channel member having an I-shaped cross-section, each said channel member including a top rail, a bottom rail disposed parallel to the top rail, and a web extending perpendicularly between the top and bottom webs so as to define two channels on opposite sides for the web for receiving the flanges extending along the edges of two adjoining modules.

2. The building system according to claim 1 further including cooperative securing means for securing the flanges in the respective channels of the channel member.

3. The building system according to claim 2 wherein the cooperative securing means includes a recess formed in the flange of the building module and a mating projection formed on the channel member for engaging the recess in the flange.

4. A modular building system comprising:

a) a plurality of saddle-shaped modules adapted to be joined together to form a space-enclosing structure, each saddle-shaped module including two continuously curved surfaces joined by four edges lying in respective planes of a circumscribing cube, and a rigid flange extending along each edge perpendicularly from the plane of the circumscribing cube, each flange including generally planar top and bottom surfaces and an end surface, and wherein the top and bottom surfaces of the flange join respective curved surfaces of a respective edge, and wherein the end surface of the flange is disposed parallel to said edge so that the flange of one module can be joined with the flange of an adjacent module in two different joint configurations; and b) connecting means for adjoining a flange of one saddle-shaped module with a flange of another saddle-shaped module so as to connect the saddle-shaped modules together.

5. The building system according to claim 4 wherein the connecting means includes an elongated channel member having two channels for receiving the flanges of respective modules.

* * * * *